US006164361A

United States Patent [19]

Meyer

[11] Patent Number: 6,164,361

[45] Date of Patent: Dec. 26, 2000

[54] ONE-WAY INSECT SCREEN

[76] Inventor: Gregory D. Meyer, 450 Partridge Hill, Williston, Vt. 05495

[21] Appl. No.: 09/514,231

[22] Filed: Feb. 28, 2000

[51] Int. Cl.[7] ..... E06B 9/52

[52] U.S. Cl. ..... 160/12; 160/180

[58] Field of Search ..... 160/12–17, 180, 160/116

[56] References Cited

U.S. PATENT DOCUMENTS

| | | | |
|---|---|---|---|
| 262,168 | 8/1882 | Wells | 160/14 |
| 603,717 | 5/1898 | Zook | 160/17 |
| 686,981 | 11/1901 | Long | 160/180 |
| 806,184 | 12/1905 | Powers | 160/15 |
| 884,145 | 4/1908 | Goodman | 160/15 |
| 904,090 | 11/1908 | Salokar | 160/12 |
| 982,270 | 1/1911 | Guenthner | 160/12 |
| 1,020,830 | 3/1912 | Knuzelman | 160/16 |
| 1,699,402 | 1/1929 | Marsden | 160/15 |
| 2,024,090 | 12/1935 | Cadamus | 160/180 |
| 3,985,174 | 10/1976 | Bricker | 160/180 |
| 5,117,890 | 6/1992 | Taylor et al. | 160/180 |

*Primary Examiner*—Blair M. Johnson
*Attorney, Agent, or Firm*—Fenwick & West LLP

[57] ABSTRACT

A one-way insect screen limits ingress of insects to an enclosed area, yet allows egress of insects from the enclosed area, by inclusion of a number of one-way passageways. The passageways are made by a number of flaps, moveable by insects making egress but not readily moveable by insects attempting to make ingress. Flaps of varying sizes are used for different sized insects. Alternatively, flaps that require relatively little force to open a small way, but more force to open further, permit egress of different sized insects while limiting ingress of such insects.

16 Claims, 2 Drawing Sheets

ONE-WAY INSECT SCREEN

BACKGROUND

A. Technical Field

The present invention relates generally to screen systems for limiting the movement of insects, and more particularly, to a screen system that permits movement of insects in one direction through the screen but limits movement of insects in a second direction through the screen.

B. Background of the Invention

Many different systems are known for limiting the exposure of humans and animals to insects and other pests. One common type of system is a mesh screen that provides openings that allow light and air to pass but are too small to allow insects to pass. These screens are extremely effective in many environments, such as window openings, patios, tents, and the like.

However, one shortcoming of such conventional screens is that where the environment includes openings such as doors or flaps large enough for humans to pass into or out of the screened area, opportunities exist for the entry of insects if those openings are not promptly secured.

For example, if a child leaves a screened-in patio door open, insects can freely enter through that door opening until the door is once again closed. In many recreational applications, such as in boats, tents, and the like, frequent use of doorways, companionways, and flaps can lead to the entry of numerous insects. As to those insects, the screen now is counter-productive in that it keeps such insects inside the area, where they are not wanted.

In other applications, screens are erected to enclose areas that may already have insects within them. For instance, screened outdoor "rooms" with waterproof tops, screened sides, and no floors are commonly erected on residential lawns, where undesirable insects are present both in the air and in the grass.

Accordingly it is desirable to provide a screen system that limits the entry of insects to an area enclosed by the screen system yet permits insects already in that area to escape.

SUMMARY OF THE INVENTION

In accordance with the present invention, a screening system limits the ability of insects located outside an enclosed area from entering the area, and allows insects already in the enclosed area to escape from the enclosed area through a unidirectional passageway.

In one aspect of the invention, the unidirectional passageway is formed by a flap member readily moveable by an insect traveling in a first direction through the screen and less readily moveable by an insect traveling in a second direction.

In an additional aspect of the invention, the flap member is deformably fixed to a screen grid portion of the mesh screen. In a further related aspect, the flap is larger than a corresponding opening in the screen grid portion. In an alternate related aspect, the flap is slightly smaller than a corresponding opening in the screen grid portion and deforms more easily in one direction than in another.

In an alternate aspect of the invention, the flap is hinged to the screen grid.

In still another alternate aspect of the invention, the screening system includes plural flaps of different sizes and moveable under different amounts of force to permit insects of varying sizes and strengths to exit thorough the screen while still limiting the entrance of all such insects through such screen.

In yet another alternate aspect of the invention, the screen is configured to attract insects from the side of the screen facing in to the enclosed area, and is configured to repel insects from the side of the screen facing out of the enclosed area.

In yet another alternate aspect of the invention, a unidirectional passageway is placed adjacent to a floor location to permit passage of crawling insects.

The features and advantages described in the specification are not all-inclusive, and particularly, many additional features and advantages will be apparent to one of ordinary skill in the art in view of the drawings, specifications, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENTS

The figures depict a preferred embodiment of the present invention for purposes of illustration only. One skilled in the art will readily recognize from the following discussion that alternative embodiments of the structures and methods illustrated herein may be employed without departing from the principles of the invention described herein.

Figure 1:
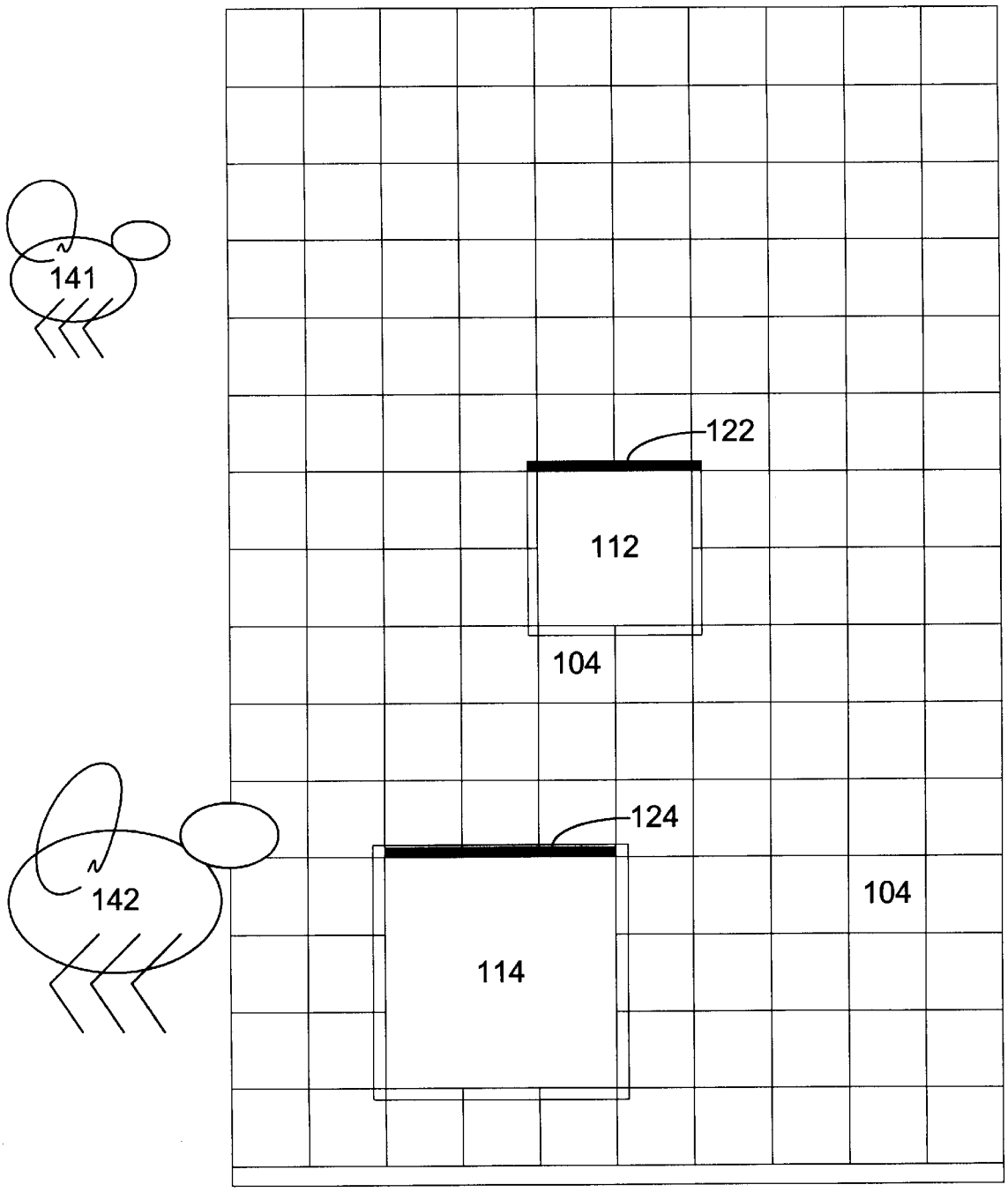
FIG. 1 is a frontal view of a screen system 100 in accordance with the present invention.

Referring now to FIG. 1, there is shown a frontal view of a screening system 100 in accordance with the present invention. In application, screening system 100 is usable to form a part of a screened enclosure, such as a patio wall, window screen, tent door or window, boat hatch, or the like.

Screening system 100 includes a number of conventional screen grids, e.g., 104, such as are typically found on window screens. These grids 104 are commonly constructed from woven aluminum or formed nylon.

Screening system 100 further includes a plurality of unidirectional passageways, e.g., 112, 114. In the embodiment illustrated in FIG. 1, these passageways are shown as flaps connected at their tops to the screening system 100 by a connecting member 122, 124. In the embodiment shown in FIG. 1, flaps 112 and 114 are constructed to be slightly larger than the screen openings over which they are positioned, and are shown to be transparent for purposes of illustration.

Figure 2:
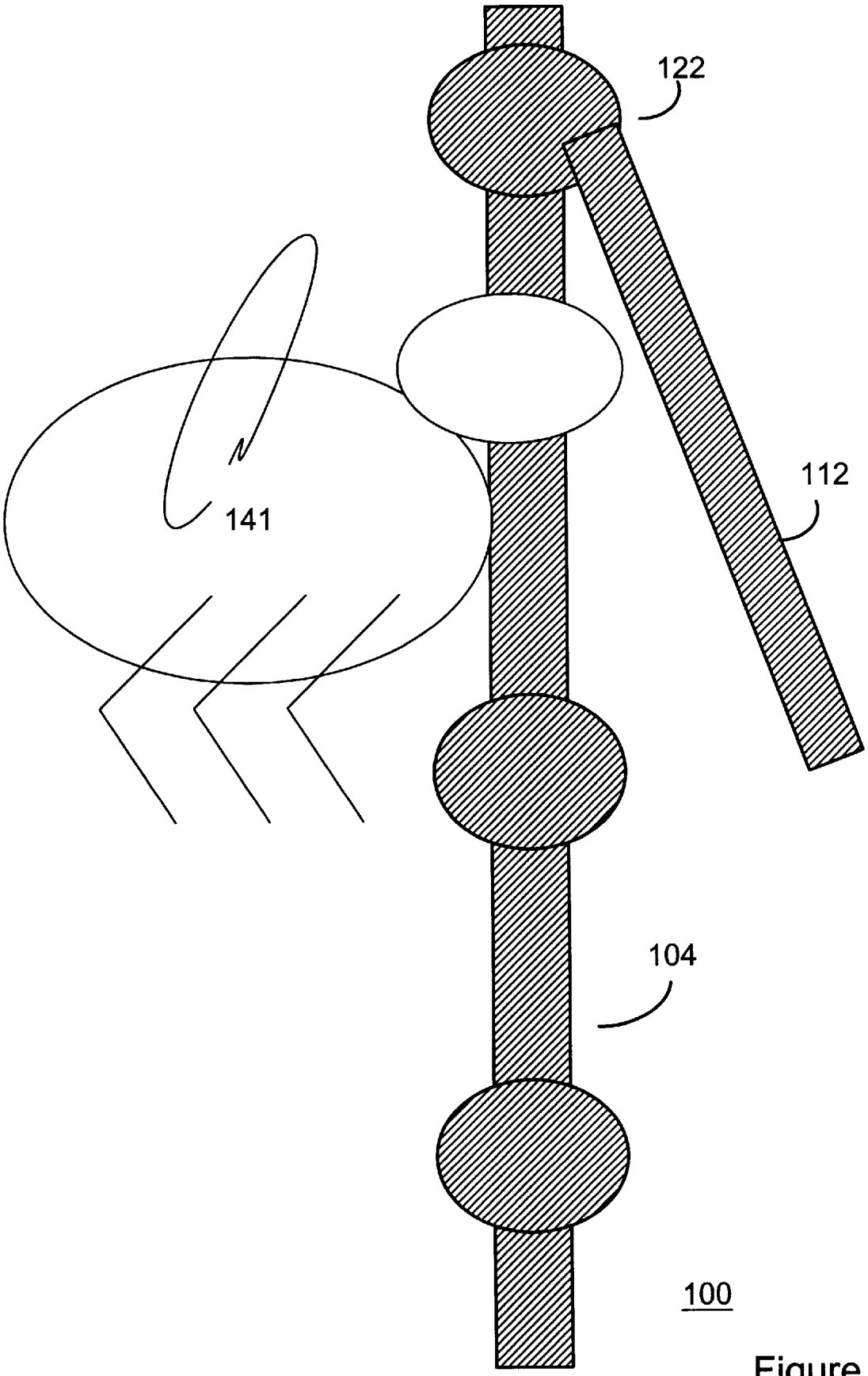
FIG. 2 is a sectional view of a portion of screen system 100 in accordance with the present invention.

Referring now also to FIG. 2, there is shown a partial cross section of screening system 100. As shown in FIG. 2, the flaps, e.g., 112 are attached to screening system 100 by connecting members, e.g., 122, such that the lower portion of the flap is readily moveable in one direction (i.e., toward the right in FIG. 2) but not so readily moveable in another direction (i.e., toward the left in FIG. 2).

In this manner, an insect (e.g., 141) is limited from moving from right to left through screening system 100, but is able to move from left to right through screening system 100 because the opening covered by flap 112 is large enough for the body of the insect to fit through once the insect has pushed on flap 112.

In a preferred embodiment, screening system 100 is formed entirely of nylon or other synthetic material that permits all components to be molded or otherwise formed of the same material.

Flap 112 is shown as being larger than the opening it covers in FIGS. 1 and 2, but that is not necessary to operation of the screen system. For example, by forming connecting member 122 and flap 112 such that deformation of the bottom of the flap requires less force in one direction than another, unidirectional passage results.

FIG. 1 illustrates two flaps 112, 114 of different sizes. These are provided to permit passage of insects of different sizes, e.g., insects 141, 142. Another way to accomplish unidirectional passage for varying sizes and strengths of insects is to form a flap (e.g., 114) such that it will move a limited amount with a small amount of force applied by the insect and a larger amount by a larger force applied (e.g., by a larger insect). Such implementation may be achieved, for example, by reinforcing the flap (114) with bendable ribs that extend downward from connecting member 122, becoming smaller and more easily flexible as they progress toward the bottom of the flap. Alternatively, placing a central vertical rib on flap 114 permits smaller insects to escape by deforming only an edge of the flap. In still another embodiment, the flap is constructed of thicker material near the top edge (e.g., near connecting member 122), and feathers down to thinner material near the bottom edge, making it inherently easier for a smaller insect to deform the flap slightly and more difficult for an insect to deform the flap to a greater degree. In any of these configurations, an insect is able to move the flap enough to make egress from the enclosed area, but not to make ingress to the enclosed area.

Depending on the particular application at hand, and the type of insect anticipated to be present, numerous such variations in the formation and variations of flaps or other unidirectional passageways are usable.

FIGS. 1 and 2 show, for illustration purposes only, two unidirectional passages in screening system 100. However, in typical embodiments, far more passages are provided. For example, in one embodiment a screening system 100 is provided with regularly alternating areas of two or three rows or columns of smaller conventional grids (e.g., 104) and larger unidirectional passages (e.g., using flaps such as 112). Factors such as amount of air/light desired for the application, structural strength, weight, desired time for outward insect migration, and the like will determine the optimal configuration for any particular application.

In some applications, use of only, or primarily, unidirectional passages may be advantageous. For example, the use of flaps, e.g., 112, provides a water-shedding effect that may be helpful to reduce the amount of moisture that enters an outdoor living area, such as a patio or tent, as a result of a rainstorm. Additionally, selective use of transparent, translucent, or opaque materials for flaps, e.g., 112, permits control over how much light is permitted to enter the enclosed area, which may be very helpful in controlling climate extremes. Some materials are known to change color or translucence with temperature or incident light, and one example of climate control in connection with a screening system 100 is use of a material for flap 112 that transmits more light when cold than when warm, so that on hot, sunny days the amount of sunlight that is incident on the area enclosed by screening system 100 is less than on cooler, cloudy days.

While conventional square-shaped grids are shown for illustration, other shapes such as hexagons could be employed as well for both grids, e.g., 104 and unidirectional passageways, e.g., 112.

FIG. 2 illustrates flap 112 being configured to leave an open space between the bottom of the flap and the adjacent portion of screen system 100. This opening both permits the passage of some air and further entices insects to attempt to crawl or fly through the opening. The ordinary size of the opening will depend on the desired application and types of insects expected to be encountered. The opening should not be so large that insects on the outside of the screened area are able to readily move the flap to a more open position and thereby achieve ingress, while the opening should be large enough so that insects on the inside of the screened area are able to move the flap and achieve egress.

One additional benefit of providing some opening between the flap and the remainder of the screening system is that it can provide a "perch" for an exiting insect which the insect can use to gain additional leverage in moving the flap to a more open position.

In some applications, it may not be desirable to leave such an opening, and therefore in an alternate embodiment, flap 112 closes completely, or nearly completely, against screening system 100. The amount of opening to leave depends on the types of insects likely to be found in any particular application, as some may not effectively use the flap unless they can see that it already provides a partial opening, while others may be heavy enough that just their crawling adjacent to the flap 112 will deform it enough to inform the insect of this passageway.

Connecting members 122, 124 may, but need not be, integrated with other materials used for flaps 112, 114 or the remainder of screening system 100. For example, in one embodiment connecting members 122, 124 are constructed as hinges about which the top edge of flaps 112, 114 pivot. In another embodiment, connecting members 112, 124 are more rigid, with movement of flaps 112, 114 being accomplished by deformation of the flaps themselves. In either instance, connecting members 122, 124 are constructed in a preferred embodiment so that flaps 112, 114 have a resting position that results in a small space remaining between the bottom of the flap and the remainder of screening system 100. In an alternate embodiment using flaps smaller than the opening they obstruct, connecting members 122, 124 are constructed to permit movement of the corresponding flap 112, 114 in one direction (i.e., toward the right in FIG. 2) with a minimal effort such that an insect could escape from an the enclosed area, while not permitting movement in another direction (i.e., toward the left in FIG. 2) as easily, to keep insects from entering the enclosed area.

FIGS. 1 and 2 illustrate unidirectional passages being located centrally in screening system 100, but it may also be desirable to locate such passages at other places. For example, placement at the lowest portions of screening system 100 permits unidirectional passage of non-flying (i.e., crawling) insects, while placement near a ceiling permits efficient egress for insects that naturally move toward a ceiling.

In order to increase the effectiveness of system 100 in providing unidirectional passage of insects, in one embodiment each side of the screen is made differentially attractive/non-attractive to insects to lure/repel them as desired. For example, referring again to FIG. 2, the inside-facing portion of the screen (i.e., the left-most portion of system 100 in FIG. 2) in one embodiment is constructed in a color that is attractive to insects, while the outside-facing portion of the screen (the right-side portion in FIG. 2) is constructed in a color that is not attractive to insects. Other characteristics that attract or repel insects are likewise optionally incorporated into screen system 100. For example, particular insects may find certain textures (e.g, smooth, rough, ridged) to be attractive, and the portions adjacent to the inside part of the unidirectional passage can be formed so as to take advantage of this, while the outside portions are formed to be non-attractive.

From the above description, it will be apparent that the invention disclosed herein provides a novel and advantageous one-way insect screen that limits ingress of insects into an enclosed area yet allows egress of insects that may find their way into the enclosed area. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A screening system limiting ingress of insects into an area, the insects having a nominal size corresponding to a minimal opening through which they can pass, the screening system comprising:

a mesh insect portion;

a plurality of openings in said screen larger than the screen mesh;

a plurality of closures, the closures adapted to be readily operable by insects making egress from the area to provide a space at least as large as the nominal size as the insects making egress and less readily operable by insects making ingress to the area;

each of the closures comprises a flap portion;

the closures farther comprising a first side, toward the area, having a color which is attractive to pests making egress from the area and a second, opposite side, away from the area, having a color which is not attractive to pests attempting to make ingress to the area.

2. A system as in claim 1, wherein each of the closures further comprises:

a connecting member joining the flap portion to the screen portion such that the flap portion is readily moveable by insects making egress from the area and less readily moveable by insects attempting to make ingress to the area.

3. A system as in claim 2, wherein the flap portion is readily deformable by insects making egress from the area and less readily deformable by insects attempting to make ingress to the area.

4. A system as in claim 2, wherein the connecting member comprises a hinge.

5. A system as in claim 2, wherein movement of the flap portion in a direction corresponding to ingress of insects is limited by the flap portion contacting the screen portion.

6. A system as in claim 2, wherein the flap portion is disposed so as to be not coplanar with the screen portion.

7. A system as in claim 1, wherein the area includes a floor portion and the plurality of closures include a subset of closures disposed adjacent to the floor portion.

8. A screening system limiting ingress of insects into an area, the insects having a plurality of nominal sizes corresponding to a minimal opening through which each can pass, the screening system comprising:

a mesh insect screen portion;

a plurality of openings in said screen larger than the screen mesh;

a plurality of closures, the closures adapted to be readily aperable by insects making egress from the area to an extent, corresponding to the plurality of nominal sizes, as the insects make egress; and less readily operable by insects making ingress to the area.

9. A system as in claim 8, wherein each of the closures further comprises:

a connecting member joining the flap portion to the screen portion such that the flap portion is readily moveable by insects making egress from the area and less readily moveable by insects attempting to make ingress to the area.

10. A system as in claim 9, wherein the flap portion is readily deformable by insects making egress from the area and less readily deformable by insects attempting to make ingress to the area.

11. A system as in claim 9, wherein the connecting member comprises a hinge.

12. A system as in claim 9, wherein movement of the flap portion in a direction corresponding to ingress of insects is limited by the flap portion contacting the screen portion.

13. A system as in claim 9, wherein the flap portion is disposed so as to be not coplanar with the screen portion.

14. A system as in claim 8, wherein the area includes a floor portion and the plurality of closures include a subset of closures disposed adjacent to the floor portion.

15. A system as in claim 8, wherein the extent to which the closures are opened is attained in response to different amounts of force being applied by insects making egress.

16. A system as in claim 8, wherein the closures comprise a plurality of the flaps, the flaps having a plurality of sizes corresponding to the different nominal sizes.

* * * * *